United States Patent [19]

Van Den Heuvel

[11] Patent Number: 4,979,454

[45] Date of Patent: Dec. 25, 1990

[54] JET SKI SAFETY DEVICE

[76] Inventor: Ernest A. Van Den Heuvel, 93 Country Club La., Pomona, N.Y. 10970

[21] Appl. No.: 456,805

[22] Filed: Dec. 26, 1989

[51] Int. Cl.[5] ..... B63B 35/00

[52] U.S. Cl. ..... 114/270; 441/75; 280/14.3

[58] Field of Search ..... 440/38; 441/74, 75, 441/73, 76, 70; 280/14.2, 14.3, 24, 11.36, 637; 114/270, 362

[56] References Cited

U.S. PATENT DOCUMENTS

| | | | |
|---|---|---|---|
| 1,510,532 | 10/1924 | Zorn | 280/18 |
| 2,677,551 | 5/1954 | Berg | 280/18 |
| 2,969,037 | 1/1961 | Vogt | 114/270 |
| 3,432,181 | 3/1969 | McKee | 280/18 |
| 3,579,682 | 5/1971 | Wood | 280/18 |
| 4,028,761 | 6/1977 | Taylor | 441/65 |
| 4,106,143 | 8/1978 | Lucas | 441/74 |
| 4,604,070 | 8/1986 | McKee | 441/70 |
| 4,619,619 | 10/1986 | Muse, Jr. | 441/65 |
| 4,669,992 | 6/1987 | Morris | 441/65 |
| 4,678,445 | 7/1987 | Monreal | 441/72 |

FOREIGN PATENT DOCUMENTS

| | | | |
|---|---|---|---|
| 0291293 | 12/1986 | Japan | 441/75 |
| 2124158 | of 0000 | United Kingdom | 114/270 |

*Primary Examiner*—Joseph F. Peters, Jr.
*Assistant Examiner*—Edwin L. Swinehart
*Attorney, Agent, or Firm*—Stanley J. Yavner

[57] ABSTRACT

A jet ski safety device includes a flexible tube of elongate material, which may be made of rubber. The ends of the elongate material are securely attached, by means of plates or brackets, to the surface of a jet ski, so that the material bridges across the top of the foot of the user or rider for the clearance. A spring is provided between the elongate material and the attachment bracket to maintain the elongate material out of contact with the foot of the user, thereby avoiding discomfort during normal use of the jet ski. When the rider is catapulted in the forward direction, at least one foot of the rider engages the elongate material to prevent the rider from being thrown over a handle bar or similar structure.

11 Claims, 2 Drawing Sheets

JET SKI SAFETY DEVICE

BACKGROUND OF THE INVENTION

1. Field of the Invention

The present invention generally relates to jet skis, and more particularly to a safety device for restraining the feet or legs of the jet skier.

2. Description Of The Prior Art

Jet skis have become more and more popular over the years. Numerous attempts have been made to make these safe. However, with regard to those jet skis on which the user stands during use, there is still the danger that a sudden deceleration of the jet ski, intentional or unintentional, can cause the user to catapult or be propelled in the forward direction, so that the user is thrown forwardly and possibly in front of the jet ski. The user can, under those circumstances, be injured by the still moving jet ski.

A number of attempts have been made to develope various foot restraints for use in connection with both skiboards, waterski scooters and the like. Thus, in U.S. Pat. No. 2,969,037 a water ski scooter is disclosed in which conventional water skis are provided which include receptacles for receiving the feet of the skiers. Such foot receptacles are sometimes uncomfortable and restrain the user, and are not always provided on jet skis. Being in constant contact with the feet of the user, they can rub against, irritate and cause discomfort to the user.

Similar foot restraints are disclosed in U.S. Pat. No. 4,678,445.

In U.S. Pat. No. 4,619,619, a combination surf board-knee board is disclosed which shows a surf board including an ankle strap and a knee strap for safety purposes. In U.S. Pat. No. 4,669,992 a knee strap is also disclosed for use with a seat support used in a recreational water slide.

Thus, while numerous restraints have been disclosed in connection with various water recreational devices, none deal specifically with jet skis, and none of the restraining devices are directly suitable or applicable for restraining at least one foot or two feet of a user on a jet ski for preventing possibly serious injuries when the rider is catapulted forward at the high speeds that jet skis move.

SUMMARY OF THE INVENTION

It is an object of the present invention to provide a jet ski restraining device which is mounted proximate to the surface on which a user stands on the jet ski, and which restrains the user when there is a tendency to catapult him over the front of the jet ski.

It is another object of the present invention to provide a jet ski safety device which is simple in construction and economical to manufacture.

It is still another object of the present invention to provide a jet ski safety device which is simple and convenient to attach to an existing jet ski.

It is yet another object of the present invention to provide a jet ski safety device which is effective and yet does not rub against, irritate or otherwise create discomfort to the rider.

In order to achieve the above objects, as well as others which will become apparent hereafter, a jet ski safety device in accordance with the present invention restrains at least one foot or leg of a user positioned on the surface of the jet ski. The device includes a pre-determined length of flexible elongate material. Resilient means are provided secured to each end of said elongate material. Attaching means is provided for attaching said resilient means to the surface of the jet ski so that said elongate material bridges across the top of the foot or back of the leg of the user with a clearance. In this manner, said elongate material does not contact and create discomfort to the user during normal use of the jet ski but engages the user's foot or leg when the user is catapulted in the forward direction to prevent being thrown over a handle bar or the like of the jet ski.

BRIEF DESCRIPTION OF THE DRAWINGS

Further objects of the present invention in addition to those set forth above will become apparent to those skilled in the art and the following description taken in connection with the accompanying drawings, wherein.

DESCRIPTION OF THE PREFERRED EMBODIMENTS

Figure 1:
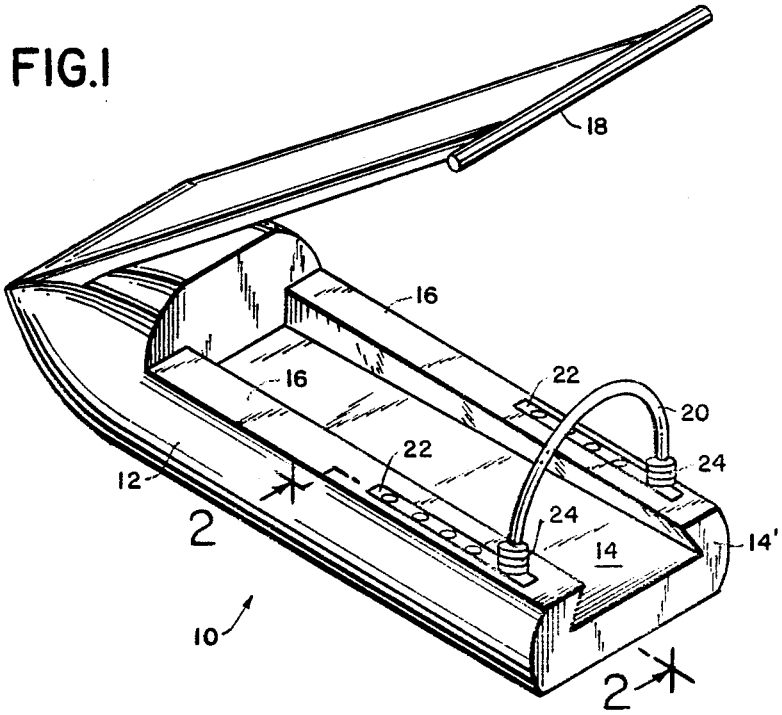
FIG. 1 is a perspective view of a jet ski incorporating the safety restraining device in accordance with the present invention.

Referring now specifically to the figures, in which similar or identical parts are designated by the same reference numerals throughout, and first referring to FIG. 1, a jet ski is generally designated by the reference numeral 10. The jet ski has a main body portion 12 having a major upper surface 14 which extends substantially along the length of the jet ski and provides a surface on which a user of the jet ski can stand. Disposed on each side of the major surface 14 are two raised rails 16 which, in this configuration, create a generally U-shaped cross-section of the jet ski, as is best evident from viewing the rear of the jet ski. A handle bar 18 is provided and held by the user both for stability and for controlling the operation of the jet ski.

The ski safety device in accordance with the present invention includes a pre-determined length of flexible elongate material designated by the reference numeral 20. The element 20 can be in the nature of a rope or a strap. For example, the element 20 may be a rubber tube or hose which measures approximately 64 inches in length and ¾" in diameter. The specific dimensions of the element 20 are not critical for purposes of the present invention, except as will become apparent hereafter.

Resilient elements are provided at each end of the elongate element 20. In the embodiment shown, the resilient elements are in the nature of low tensile springs 4, although pivots may be used for this purpose. The springs 24, pivots or other flexible or resilient members are attached to the rails 16 by any suitable means. In the embodiment shown in FIGS. 1 and 2, such attachment members 22 are in the form of U-shaped aluminum plates which are advantageously recessed within the rails 16 so as not to protrude or project above the rails. In this way, the top surface of the plates 22 are flush with the top surface of the rail 16. The plates 22 are provided with counter-bore holes 22' through which screws 26 can be used to secure the plates to the rails 16.

Figure 2:
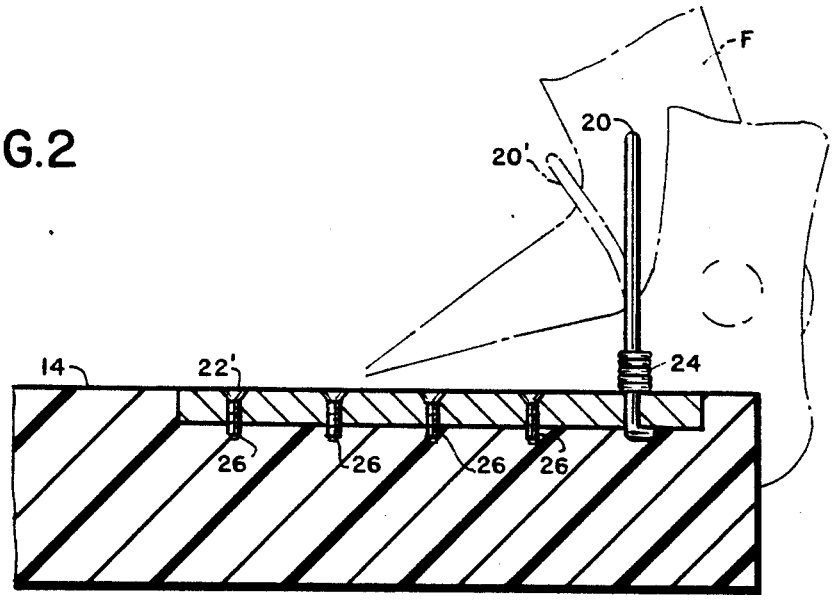
FIG. 2 is an enlarged cross-sectional view of the safety device shown in FIG. 1, taken along line 2—2.

The length of the elongate strap 20 is selected so that it bridges across the top of the foot F or back of the leg with clearance. In this way, the strap 20 does not contact and create discomfort to the user during normal use of the jet ski. In FIG. 2, the foot F of the user is shown in its normal standing position, in which event the strap loops straight across the foot without touching it. When the user is thrown in the forward direction, the rider's foot engages the strap 20 and moves it to position 20'. The strap, therefore engages the user's foot when the user is catapulted in the forward direct to prevent being thrown over the handle bar 18 or the like to the jet ski. In the same manner, restraint is performed when the strap is across the back of the leg of the user or across anywhere on a lower extremity.

Figure 3:
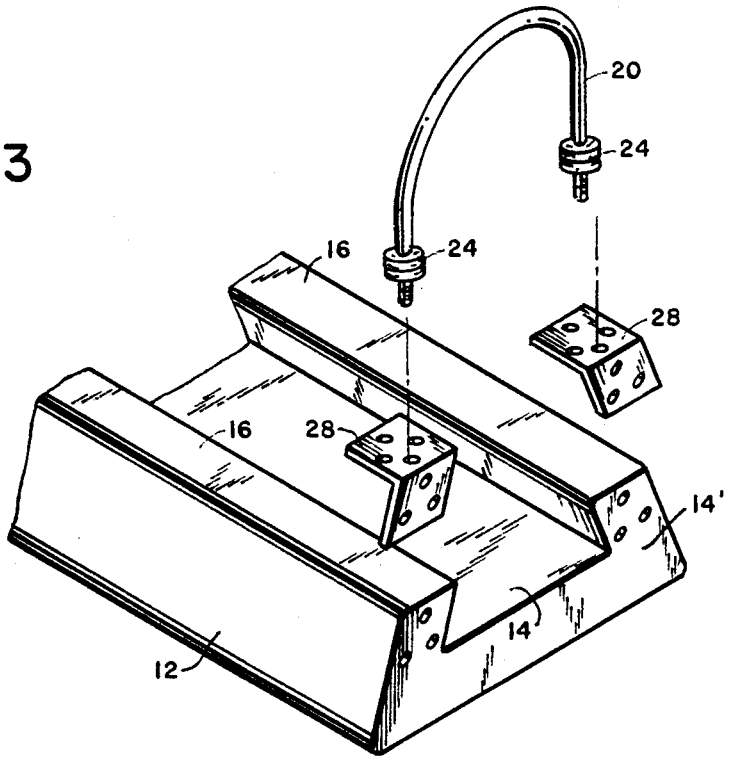
FIG. 3 is a fragmented and exploded view of the jet ski shown in FIG. 1, showing another embodiment of the safety device prior to assembly or mounting on the jet ski.
Figure 4:
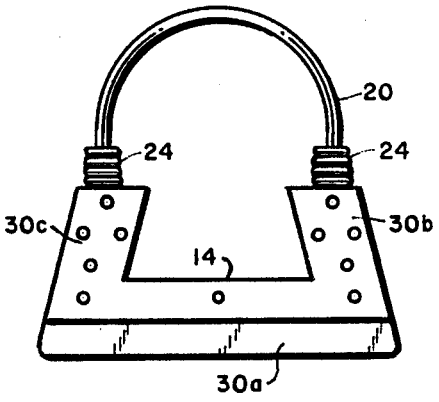
FIG. 4 is a rear elevational view of a jet ski of the type shown in FIG. 1, showing still another embodiment of an attachment member for the safety device mounted on the rear surface of the jet ski.

The specific method of attaching the strap 20 is not critical. In FIG. 1 a pair of elongate plates are mounted on the rails 16, each plate 22 being recessed so as to have its upper surface coextensive with the upper surface of the rails 16. In FIG. 3, a pair of brackets 28 are shown which can be used, the angles defined by the brackets corresponding to the angle formed between the rear surface 14' and the upper surface of the rails 16. If FIG. 4, a generally U-shaped plate 30 is shown which is attachable to the rear surface 14' of the jet ski proximate to the surface 14 on which the user stands. The plate 30 includes a lower portion **30*a* and upwardly directed side portions 30*b*, 30*c*, which conform and cover the rear surface 14'**.

The strap 20 may be made of solid material, such as rubber.

The safety device in accordance with the present invention can be an after-market accessory as well as, of course, being provided as original equipment, and is effective in preventing jet skiers from being catapulted over the handle bars of the vehicles, particularly during competition. By preventing the rider's legs from moving forward, the rider could reposition himself and continue riding after being propelled in the forward direction. The rider could also position his legs on the apparatus when anticipating a wave so that he could maneuver his vehicle faster and more easily.

The ski water device in accordance with the present invention is convenient, easy to use, increases protection from injury, reliability and durability. The ski safety device has a great potential for enhancing the safety to riders of jet skis, and the reduction in the number of potential injuries resulting from being thrown forward during a ride. While the device can be used by competitive jet skiers, it could also be used by non-competitive riders who are interested in increasing their safety on the water.

It should be understood that although preferred embodiments of the present invention have been illustrated and described, various modifications, alternatives and equivalents thereof will become apparent to those skilled in the art and accordingly, the scope of the present invention should be defined only by the appended claims and equivalents thereof.

I claim:

1. A jet ski safety device for use restraining at least one lower extremity of a user positioned on an upper surface of the jet ski comprising a pre-determined length of flexible elongate material; resilient means secured to each end of said elongate material; and attaching means for attaching said resilient means to the surface of the jet ski so that said elongate material bridges across said lower extremity of the user with a clearance therebetween, whereby said elongate material does not contact and create discomfort to the user during normal use of the jet ski but engages the user's extremity when the user is catapulted in the forward direction to prevent being thrown over a handle bar or the like of the jet ski.

2. A device as defined in claim 1, wherein said elongate material comprises a strap.

3. A device as defined in claim 2, wherein said strap is solid.

4. A device as defined in claim 2, wherein said strap is made of a rubber material.

5. A device as defined in claim 1, wherein said resilient means comprises a coil spring.

6. A device as claimed in claim 1, wherein said attaching means comprises a pair of members securely attached to the surface of the jet ski and spaced from each other to be disposed on opposite sides of the surface of the jet ski.

7. A device as defined in claim. 7, wherein said members are U-shaped plates.

8. A device as defined in claim 8, wherein said members are mounted recessed so as not to project above the surface of the jet ski.

9. A device as defined in claim 1, wherein said attaching means comprises a pair of spaced brackets.

10. A device as defined in claim 1, wherein said attaching means comprises a U-shaped plate attachable to a rear surface of the jet ski proximate to the surface on which the user stands.

11. A device as defined in claim 1, wherein said elongate material is selected to have a length sufficient to bridge both lower extremities of the user with a clearance therebetween when placed on the jet ski surface.

* * * * *